US005282545A

United States Patent [19]

White

[11] Patent Number: 5,282,545

[45] Date of Patent: Feb. 1, 1994

[54] STORAGE DEVICE WITH LINER FOR TYING AND REMOVAL OF BUNDLED PAPERS

[76] Inventor: Kevin C. White, 30 Idaho Ave., Staten Island, N.Y. 10309

[21] Appl. No.: 966,695

[22] Filed: Oct. 26, 1992

[51] Int. Cl.[5] ..... B65D 25/26; B65D 71/02

[52] U.S. Cl. ..... 220/403; 100/34; 206/83.5

[58] Field of Search ..... 206/83.5, 442; 220/403, 220/404; 100/1, 34, 912

[56] References Cited

U.S. PATENT DOCUMENTS

| | | | |
|---|---|---|---|
| 2,636,432 | 4/1953 | Sherer | 100/34 |
| 2,639,037 | 5/1950 | Friend | 211/50 |
| 3,498,214 | 3/1968 | Bailey | 100/34 |
| 3,780,854 | 12/1973 | Ruppenthal | 206/46 |
| 4,681,032 | 7/1987 | McDermott | 100/34 |
| 4,934,262 | 6/1990 | Turi et al. | 100/34 |
| 4,993,318 | 2/1991 | Bollinger | 100/34 |
| 5,004,099 | 4/1991 | Carpenter et al. | 206/83.5 |
| 5,005,709 | 4/1991 | Stokes | 211/50 |
| 5,033,628 | 7/1991 | Scholes | 100/34 |

FOREIGN PATENT DOCUMENTS

| | | | |
|---|---|---|---|
| 2400346 | 4/1979 | France | 206/83.5 |

*Primary Examiner*—Jimmy G. Foster

[57] ABSTRACT

A storage and disposal system for newspapers incorporating a storage cabinet approximating the dimensions of a standard newspaper having supports placed near the top inside walls of the cabinet to receive a liner and said liner comprising opposed preformed lengths of bundling material with ends designed to engage cabinet supports positioning opened liner into empty cabinet. After periodic deposits of newspapers fill storage cabinet to capacity the added length of bundling material contained in the liner magazine are pulled out and used to complete the bundle closure without requiring the use of tools or complicated knots and remove the bundled contents of cabinet with ease.

6 Claims, 6 Drawing Sheets

FIG. 4
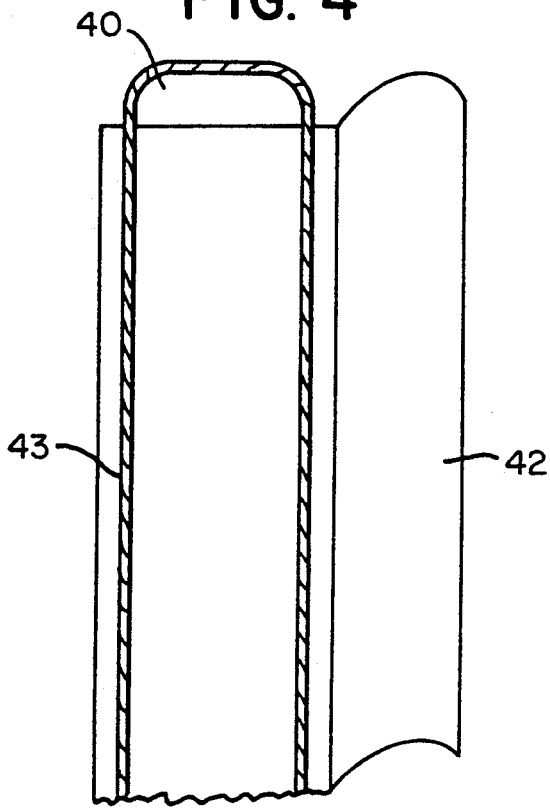
FIG. 5
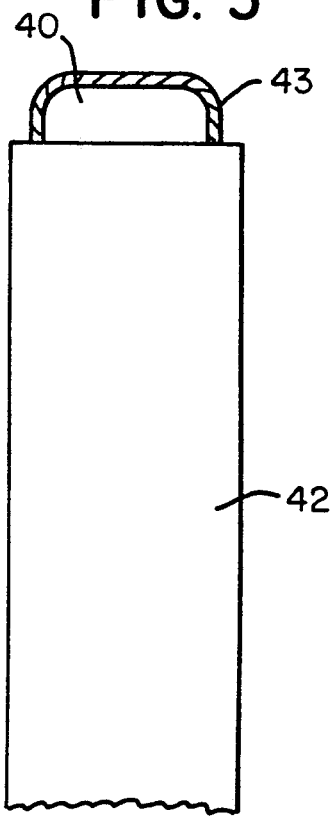
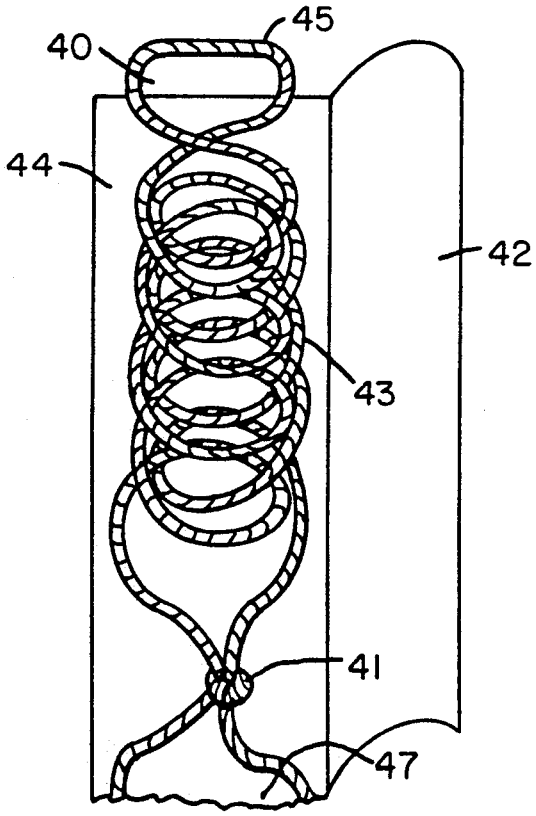
FIG. 6
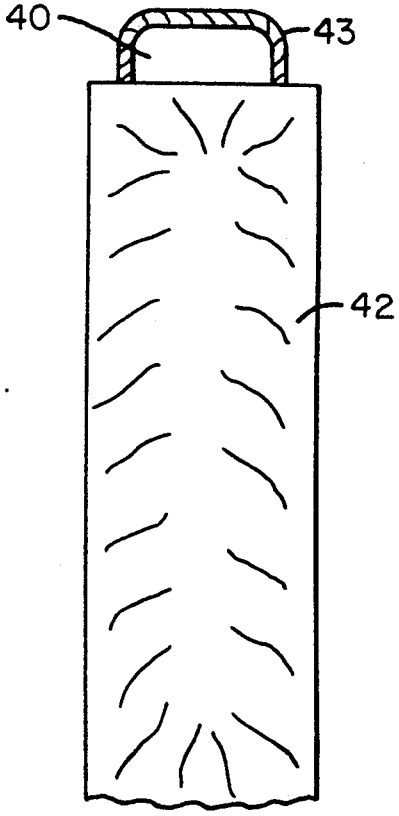
FIG. 7

STORAGE DEVICE WITH LINER FOR TYING AND REMOVAL OF BUNDLED PAPERS

BACKGROUND-FIELD OF THE INVENTION

This invention relates to paper storage or bailing and bundling devices in general, and specifically to a device designed for use s a piece of furniture which holds a liner for bundling recyclable papers.

BACKGROUND-DESCRIPTION OF PRIOR ART

Growing awareness by the general public as to the importance of conserving natural resources is prompting more people to recycle. Recycling involves amassing a quantity of stored goods until it becomes practical to remove them to their final destination whether it be a designated recycling center or pickup by public or private carters.

Newspapers and other paper products have to be tied into bundles in order to be transported. This requires some type of cord or string and the tying of knots. Attempts have been made to consolidate the storage container and some type of string dispenser. U.S. Pat. No. 5,004,099 to Carpenter and Ehster Apr. 2, 1991 and U.S. Pat. No. 4,993,318 to Bollinger, Feb. 19, 1991 both show a storage box made of paperboard or cardboard and a string magazine. U.S. Pat. No. 3,498,214 to Bailey, Mar. 4, 1968 and U.S. Pat. No. 4,934,262 to Turi, et al, Jun. 19, 1990 show a similar device but all require that the operator provide a means to cut the string and then require the operator to tie the two loose ends of each opposing string to secure the bundle. Many people lack the skill to tie secure enough knots so as to support the weight of the bundled papers. Both also require the operator of the device to provide the string and this is a disadvantage because the operator might choose a type of string that is not recyclable with paper goods. Two devices are cardboard or paperboard and although economical to manufacture, they are not suitable for display along with home furnishings. The other two mentioned prior appear too complicated to be manufactured economically. U.S. Pat. No. 5,005,709 to Stokes, Apr. 9, 1991 shows a cardboard rack for tying but all the aforementioned disadvantages apply excepting cost to manufacture. U.S. Pat. No. 3,780,854 to Ruppenthal, Dec. 25, 1973 shows a flat substantially rigid paperboard containing precut lengths of cord wound into a magazine. It addresses the problem of cutting the cord but still leaves the tying unanswered. A simpler to operate low cost means of securement is needed.

Accordingly, several objects and advantages of my invention are as follows:

To provide an attractive piece of household furniture to facilitate collection and storage closest to the area where newspapers are normally used, thus making storage of accumulated papers no longer a problem. To provide a safe, fast and easy way of securely bundling collected newspapers in their storage box. This means of bundling will require no cutting of cords or prethreading of strings. It will provide a means of securing the bundle with one simple knot. The lacing action of completing the closure ensures a tight cubic bundle which will stack easily. The predetermined length of tie material incorporated into the liner provides a convenient handle to lift the bundle after completing the closure. The bundle material and the liner itself can be made of the correct composition of material so as to be recycled along with newspapers themselves and can be produced economically by virtue of their simplicity. Further objects and advantages of my invention will become apparent from a consideration of the drawings and ensuing description.

DRAWING FIGURES

The object of the invention along with other advantages and novel features will become more apparent from the following brief description, particularly when taken in conjunction with the accompanying figures in which:

FIG. 4 is an elevation view of paper sheath unfolded with bundling material end loop positioned.

FIG. 5 is an elevation view of paper sheath folded with bundling material end loop positioned.

FIG. 6 is an elevation view of paper sheath unfolded with bundling material end loop and tie length bundling material with knot positioned in magazine.

FIG. 7 is the elevation view of paper sheath folded with bundling material end loop positioned and magazine covered.

FIG. 9 A through F are perspective views of the liners tying sequence.

Figure 10:
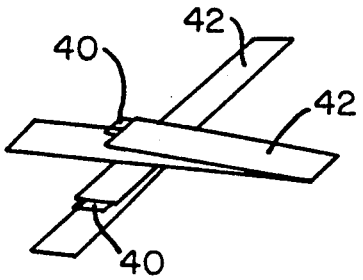

FIG. 10 is a perspective view of the liners vend position.

Figure 11:
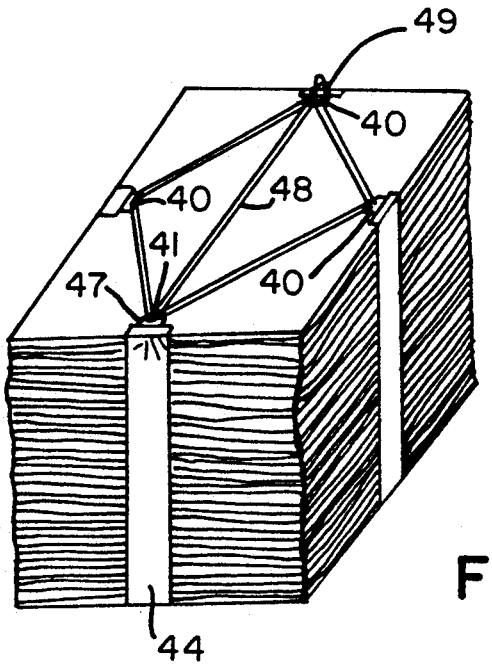

FIG. 11 is a perspective view of liner with completed closure filled with newspapers.

Figure 12:
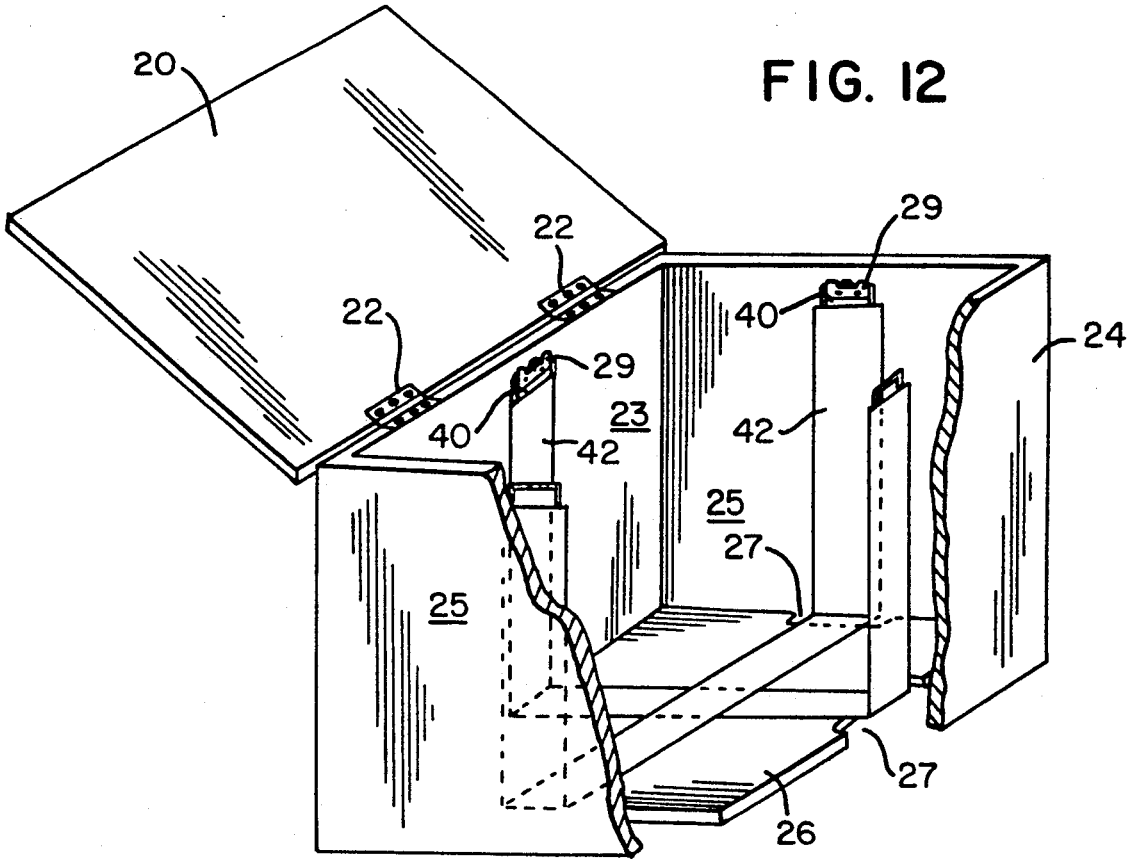

FIG. 12 is a perspective view with portions broken away of one embodiment of the storage container with liner inserted.

Figure 13:
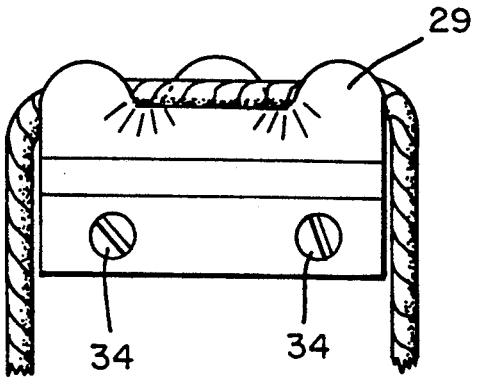

FIG. 13 is an elevation of the liner holder with bundling material end loops engaged.

| Reference Numerals in Drawings: | |
|---|---|
| 20 | lid |
| 22 | hinges |
| 23 | back wall |
| 24 | front wall |
| 25 | right end wall |
| 26 | floor |
| 27 | cutouts |
| 28 | left end wall |
| 29 | liner holder |
| 30 | liner holder notches |
| 31 | groove |
| 32 | top edge |
| 33 | pathway |
| 34 | mechanical fastener |
| 40 | bundling material end loops |
| 41 | knot |
| 42 | paper sheath |
| 43 | bundling material |
| 44 | magazine |
| 45 | tie length bundling material |
| 46 | newspapers |
| 47 | loop |
| 48 | tie length handle |
| 49 | final closure |

DESCRIPTION-MAIN EMBODIMENT

Figure 1:
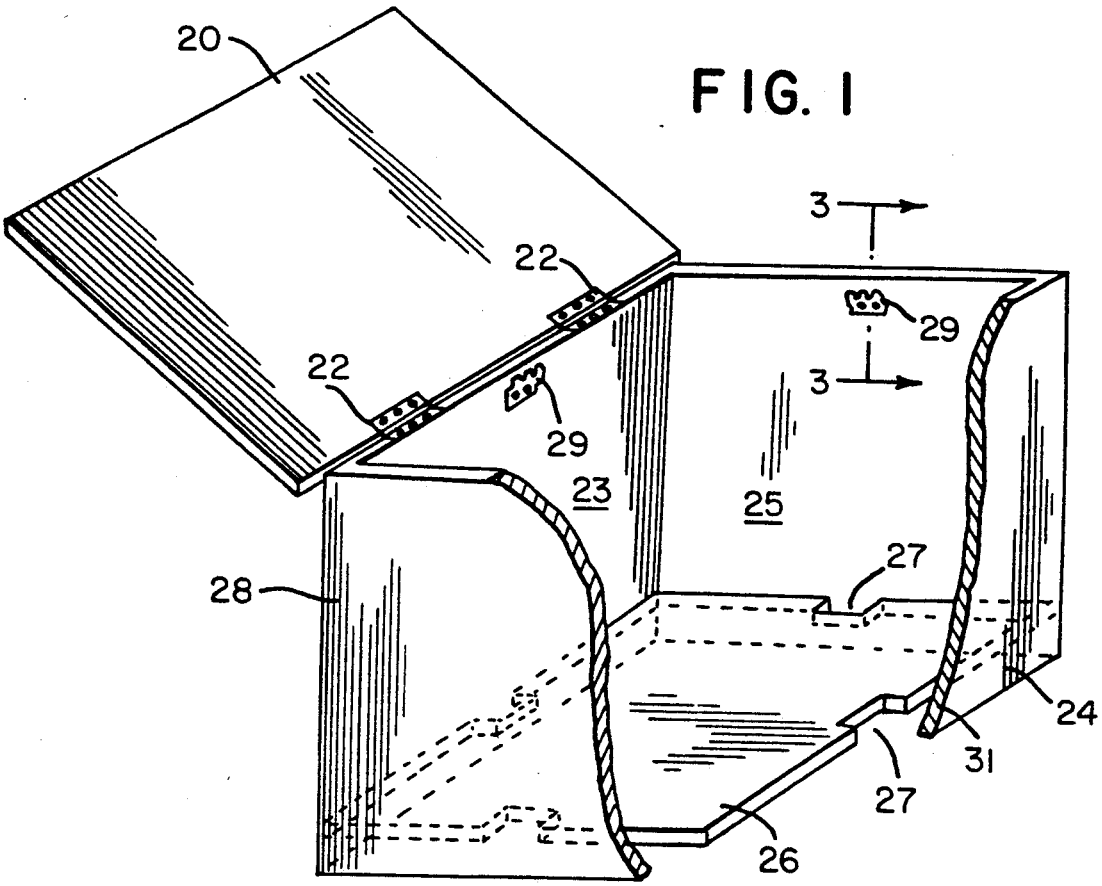
FIG. 1 is a perspective view with portions broken away of one embodiment of the storage container.

A first embodiment of my invention as shown in FIG. 1 comprises a rectangular box having a pair of vertically disposed parallel end walls 25 and 28 interconnected at their ends by a front wall 24 and a back wall 23. The box is provided with a lid 20 attached to the upper edge of back wall 23 with a pair of hinges 22. A floor panel 26 is attached to the walls near their lower ends and is received for support in a groove 31 cut in the inner faces of the walls. Floor panel 26 has cutouts 27 that act as vent holes. Liner holders 29 are mounted at the centers of the walls with mechanical fasteners 34 flush with the top edge 32 of the box.

Figure 2:
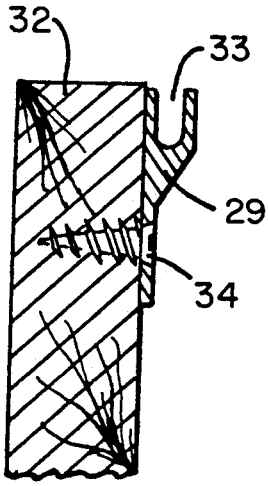
FIG. 2 is a sectional view taken along the line of 3—3 of FIG. 1.

FIG. 2 is a sectional view taken along the line of 3—3 of FIG. 1 showing the liner holder 29 fastened to the box wall 25 with mechanical fasteners 34 flush with top edge 32 providing pathway 33 for liner bundling material end loop 40.

Figure 3:
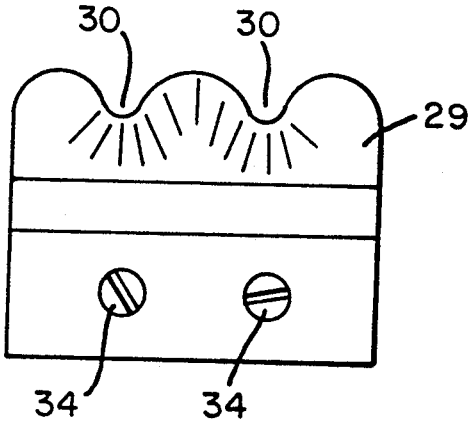
FIG. 3 is an elevation view liner holder.

FIG. 3 is a plan view of holder 29 showing mechanical fasteners 34 and notches 30 comprising pathway 33 for liner bundling material end loop 40.

FIG. 4 shows a section of paper sheath 42 open and bundle material 43 overlaid to project past the end of sheath 42 to form loop 40 after sheath 42 is closed. FIG. 5 shows sheath 42 closed and loop 40 formed from bundling material 43.

FIG. 6 shows magazine 44 section of paper sheath 42 open and tie length 45 bundling material 43 and knot 41 overlaid sheath 42 to form loop 40 after sheath 42 is closed. FIG. 7 shows sheath 42 closed and loop 40 formed from bundling material 43.

Figure 8:
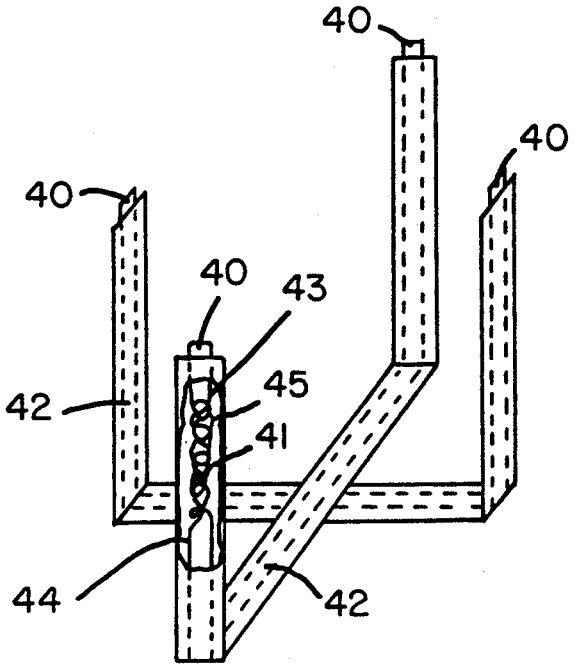
FIG. 8 is a perspective view of a liner showing underlying bundling material path with cutaway view cord magazine.

FIG. 8 shows a perspective View of one embodiment of the invention comprising a liner constructed of paper sheaths 42 covering a rope; cord; twine; string; etc. bundling material 43 cut into predetermined lengths with an added length of bundling material 43 deposited into a magazine 44 shown in a cutaway view. Lengths of bundling material 43 are arranged opposing each other and covered by a paper sheath 42 with some bundling material 43 extending past sheath 42 to form end loops 40. Tie length 45 bundling material 43 contained in magazine 44 is bound together by a splice; glue; clamp; knot; etc. 41 to provide a loop 47 for use in making final closure 49.

Figure 9A:
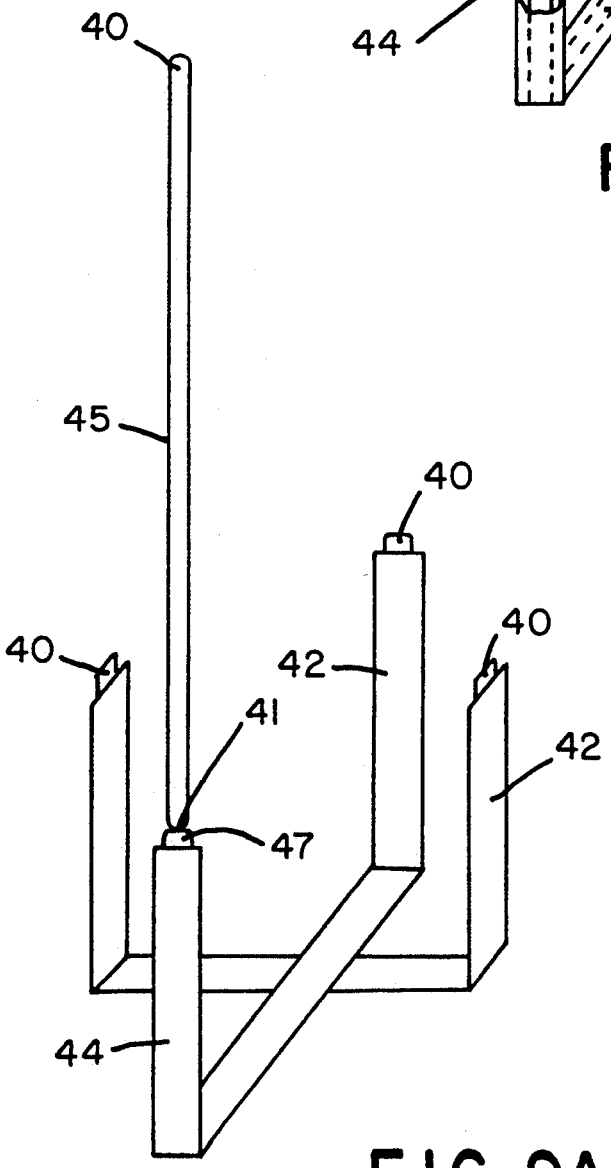
Figure 9B:
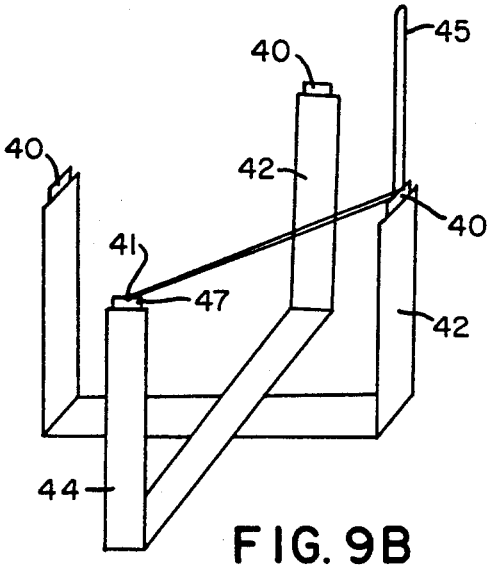
Figure 9C:
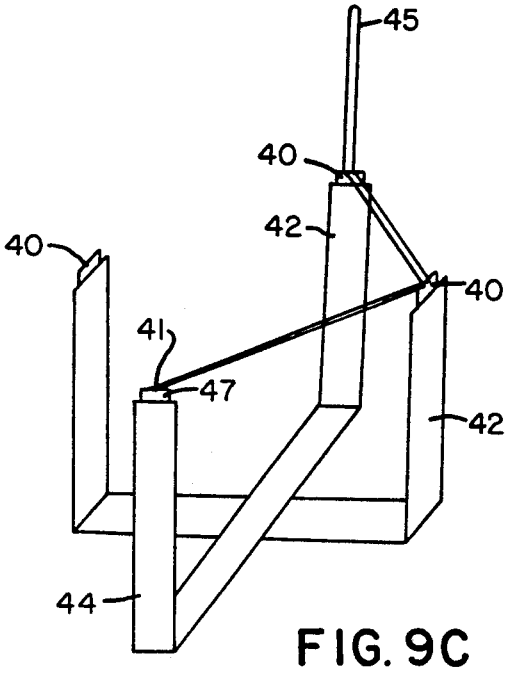
Figure 9D:
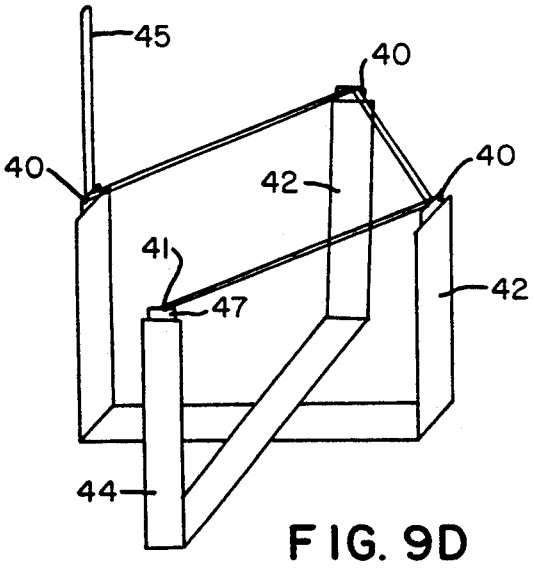
Figure 9E:
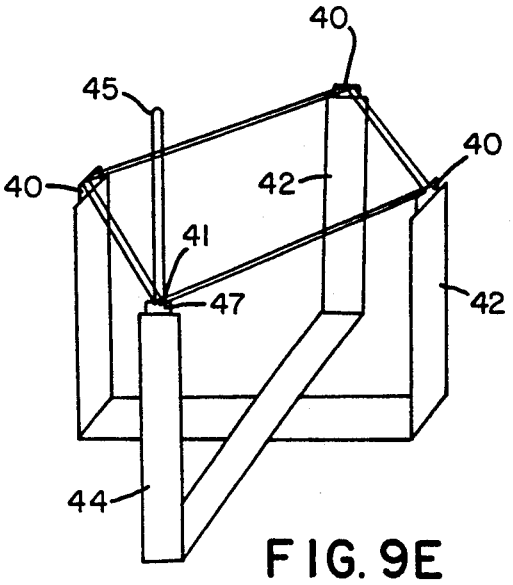
Figure 9F:
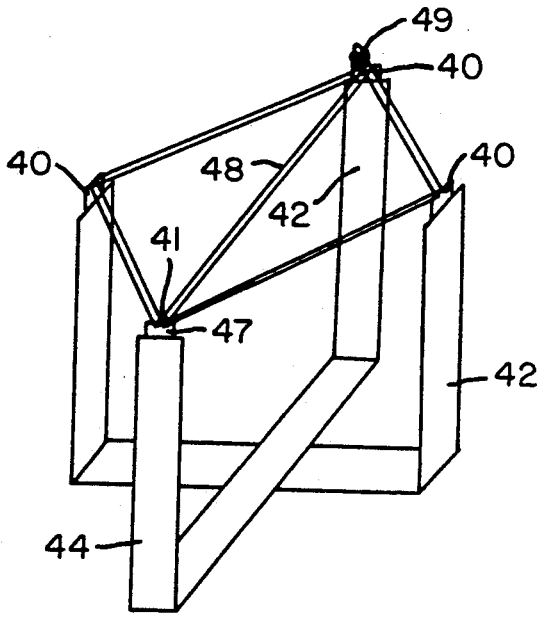

FIG. 9A through 9F show the liners bundling material 43 tie length 45 removal and bundling sequence. FIG. 9A shows tie length 45 bundling material 43 pulled from magazine 44 by end loop 40. FIG. 9B shows tie length 45 threaded through end loop 40. FIG. 9C shows tie length 45 threaded through two end loops 40. FIG. 9D shows tie length 45 threaded through three end loops 40 and FIG. 9E shows tie length 45 threaded through three end loops 40 and loop 47. FIG. 9F shows tie length 40 completely threaded and pulled tight and tied forming the final closure 49. This provides a handle 48 to lift entire bundle with.

FIG. 10 shows the liners vend position which is folded flat upon itself.

FIG. 11 shows a perspective view of liner filled with newspapers 46 after steps shown in FIG. 9A through 9F are completed and final closure 49 is made.

FIG. 12 shows a cutaway view of the first embodiment of my invention with a liner installed in liner holders 29 with bundling material 43 end loops 40 engaged in pathways 33.

FIG. 13 shows a plan view of liner holders 29 with installed bundle material 43 end loops 40 engaged in pathway 33.

OPERATION

This invention operates as a receptacle for deposit of newspapers after use. The storage area (FIG. 1) is a rectangular box approximating the size of common newsprint and is comprised of front wall 24, back wall 23, right wall 25 and left wall 28 with a lid 20 attached with hinges 22 to back wall 23 and a floor 26 received in grooves 31 with cutouts 27 that act as vent holes. Mounted on the top inside face of each wall are liner holders 29 with notches 30 (FIG. 3) that form a pathway 33 (FIG. 2) for the bundling material 43 end loops 40 to rest in (FIG. 13).

The storage receptacles' lid is opened and a liner is inserted into the empty box in its vend position (FIG. 10) and opened. As each leg of the liner is unfolded from its folded flat vend position the end loop 40 is hooked on its corresponding liner support 29 through pathway 33 until all four sides are hooked and the liner is opened against the walls of the box. The device is now ready to accept periodic deposits of newspaper (FIG. 12) until it becomes filled to capacity.

Upon reaching capacity stored contents will need to be securely bundled and removed. This is accomplished by grasping bundling material 43 end loop 40 and pulling the stored tie length 45 bundling material 43 from its magazine 44 until knot 41 which forms loop 47 appears (FIG. 9A). Tie length 45 is then laced through end loops 40 in a circular motion (FIGS. 9B, 9C, 9D until tie length 45 returns to starting point at knot 41. Tie length 45 is then laced through loop 47 (FIG. 9E) and drawn across bundle to opposite side and tied to end loop 40 which makes final closure 49 (FIG. 9F). The length of the tie length 45 remaining between loop 47 and final closure 49 comprises handle 48 (FIG. 12).

The bundled contents are now ready to be removed from the storage box. The operator will grasp the handle 48 and lift. The weight of the papers further tightens the bundle as it is lifted from the storage box. Cutouts 27 in floor 26 provide for air to enter void being created by removal of contents and nullify any vacuum effect thus easing removal.

The now empty storage box is ready to receive a new liner and entire procedure repeated.

The removed bundled contents are tightly bound and have a convenient carrying handle and are ready for storage or removal and transport to a recycling center.

SUMMARY, RAMIFICATIONS AND SCOPE

Thus, the reader will see that the storage device with liner for tying and removal of bundled papers described in my application is a very simple and useful device which will provide a fast and easy way to tightly bundle papers without requiring the use of tools or knowledge of complicated knots.

While my description contains many specifities, these should not be construed as limitations on the scope of the invention, but rather as an exemplification of one preferred embodiment thereof. Many other variations are possible. For example, liner holders 29 may be replaced with simple hooks. Cutouts 27 may be repositioned or deleted. Bundling material may be incorporated into sheath and only one strand of tie length 45 may be provided. Tie length 45 end loop 40 may be color coded or labeled so as to indicate which section of sheath 42 contains magazine 44. Sheath 42 may be deleted completely and bundling material 43 may be made rigid, etc. Accordingly, the scope of the invention should be determined not by the embodiment illustrate, but by the appended claims and their legal equivalents.

I claim:

1. A liner for bundling paper items, said liner adapted to be removably placed in a receptacle, said receptacle including a rectangular container having four vertical side walls and having a horizontal bottom panel therebetween, said receptacle also including a liner supporting device affixed to each side wall near the upper extreme thereof, said liner comprising:

(a) preformed predetermined lengths of flexible bundling material in combination with a means for imparting ridigity to said bundling material, said lengths crossing over each other providing four stiffened opposed lengths of said flexible bundling material configured for extending upwardly along an inside surface of said side walls, each said opposed length of said bundling material terminating at an end closure structure having means to engage a respective one of said liner support devices;

(b) an additional length of flexible bundling material connected to one of said end closure structures, said additional length of bundling material being dimensioned and configured such that said additional length of bundling material is adapted to engage all of said end closure structures while said opposed lengths of bundling material are extending along the side walls of the container, and is adapted to draw said end structures together, wherein said additional length of bundling material provides a means of securement for the bundled contents, and such that said additional length is capable of further forming a handle extending between two of said opposed lengths;

(c) one of said opposing lengths defining a magazine containing said additional length of bundling material in such a way that the additional length of bundling material may be drawn from the magazine.

2. A liner for bundling paper items, said liner adapted to be removably placed in a receptacle, said receptacle including a rectangular container having four vertical side walls and having a horizontal bottom panel therebetween, said receptacle also including a liner supporting device affixed to each said side walls near the upper extreme thereof, said liner comprising:

(a) predetermined lengths of flexible bundling material arranged in such a way so as to cross over each other providing four opposed lengths of said bundling material configured for extending upwardly along a inside surface of said side walls, each said opposed length of said bundling material terminating at end closure structure having means to engage a respective one of said liner support devices, said liner engaging said supports forming an open topped four sided collapsible structure;

(b) an additional length of bundling material connected to one of said end closure structures, said additional length of bundling material being dimensioned and configured such that said additional length of bundling material is adapted to engage all of said end closure structures while said opposed lengths of bundling material are extending along the side walls of the container, and is adapted to draw said end closure structures together thereby collapsing said open topped four sided collapsible structure around contents of said liner, and such that said additional length is capable of further forming a binding closure, said closure retaining said collapsible structure in its collapsed state entrapping contents placed in said open topped four sided collapsible structures, and such that said additional length is capable of further forming a handle extending between two of said opposed lengths;

(c) one of said opposed lengths defining a magazine containing said additional length of bundling material in such a way that the additional length of bundling material may be drawn from the magazine.

3. A liner for bundling paper items, said liner adapted to be removably placed in a receptacle, said receptacle including a rectangular container having four vertical side walls and having a horizontal bottom panel therebetween, said receptacle also including a liner supporting device affixed to each said side wall near the upper extreme thereof, said liner comprising:

(a) predetermined lengths of flexible bundling material being enclosed in sheaths of folded material, said sheaths crossing each other providing four sheathed, opposed lengths of said bundling material configured for extending upwardly along a inside surface of said side walls, each said opposed length of said bundling material terminating at end closure structure having means to engage a respective one of said liner support devices;

(b) an additional length of bundling material connected to one of said end closure structures, said additional length of bundling material being dimensioned and configured such that said additional length of bundling material is adapted to engage all of said end closure structures while said opposed lengths of bundling material are extending along the side walls of the container, and is adapted to draw said end closure structures together, and such that said additional length is capable of further forming a handle extending between two of said opposed lengths;

(c) one of said sheaths defining a magazine containing said additional length of bundling material in such a way that the additional length of bundling material may be drawn out of the magazine.

4. A liner as set forth in claim 3, in combination with said receptacle, each said end closure structure being engaged with a respective line supporting device.

5. A liner as set forth in claim 3, wherein each said end closure structure defined by a loop formed with said bundling material.

6. A liner as set forth in claim 3, wherein each receptacle has an inside dimension, said liner being prefolded to approximate the inside dimension of the container.

* * * * *